US005800197A

United States Patent [19]

Hyzin

[11] Patent Number: 5,800,197

[45] Date of Patent: Sep. 1, 1998

[54] CONNECTOR SYSTEM WITH QUICK COUPLING/DECOUPLING

[75] Inventor: Peter Joseph Hyzin, Lake Forest, Calif.

[73] Assignee: ITT Manufacturing Enterprises, Inc., Wilmington, Del.

[21] Appl. No.: 733,851

[22] Filed: Oct. 18, 1996

[51] Int. Cl.[6] ..... H01R 13/639

[52] U.S. Cl. ..... 439/372; 439/953

[58] Field of Search ..... 439/348, 364, 439/372, 953; 403/320, 325, 321, 322

[56] References Cited

U.S. PATENT DOCUMENTS

| | | | |
|---|---|---|---|
| 3,455,580 | 7/1969 | Howard | 285/87 |
| 3,509,515 | 4/1970 | Acord | 339/45 |
| 3,678,439 | 7/1972 | Vetter | 339/46 |
| 3,750,087 | 7/1973 | Vetter | 339/90 |
| 3,805,379 | 4/1974 | Vetter | 29/629 |
| 4,026,623 | 5/1977 | Goodman et al. | 439/953 |
| 4,047,779 | 9/1977 | Klancnik | 339/9 |
| 4,464,001 | 8/1984 | Collins | 339/90 |
| 4,542,952 | 9/1985 | Tomsa | 339/90 |
| 4,824,386 | 4/1989 | Souders | 439/348 |
| 5,129,837 | 7/1992 | Williams | 439/348 |
| 5,376,016 | 12/1994 | Inaba et al. | 439/953 |
| 5,562,458 | 10/1996 | Stora et al. | 439/348 |

FOREIGN PATENT DOCUMENTS

| | | | |
|---|---|---|---|
| 471603A | 2/1992 | European Pat. Off. | 439/348 |
| 1072158 | 2/1984 | U.S.S.R. | 439/348 |

*Primary Examiner*—P. Austin Bradley
*Assistant Examiner*—Tho D. Ta
*Attorney, Agent, or Firm*—Thomas L. Peterson

[57] ABSTRACT

A connector system is provided which enables a first connector (12, FIG. 6), especially a rectangular one, to be quickly mated and unmated from a second connector device (14), by turning a handle (74) lying rearward of the first connector, where the handle is readily accessible to turn despite the first connector lying closely adjacent to other connectors along a row. A bayonet nut (60) lies between two sets of contacts (16, 18) of a rectangular connector, at the front of the connector housing, with a shaft arrangement (84) extending rearwardly from the nut and having a handle (74) that can be turned to turn the nut to couple to bayonet thread pins (64) of a mating connector device. The shaft arrangement includes a first shaft (80) that is fixed to the bayonet nut (60) and a second shaft (82) that is fixed to the handle (74) and that is rotatably connected to the first shaft but that can be moved rearwardly to move the handle (74) rearwardly. This allows rearward movement of the handle of a selected one of a row connectors, to a rearward position (74R) where the handle can be readily grasped to be turned, instead of being closely surrounded by the handles of other connectors and/or wires (34). A release/lock rod (100) projects through and rearward of the handle (74) and can be moved axially to release the second shaft (82) to move rearwardly and to lock the second shaft in a forward position.

7 Claims, 4 Drawing Sheets

FIG. 7
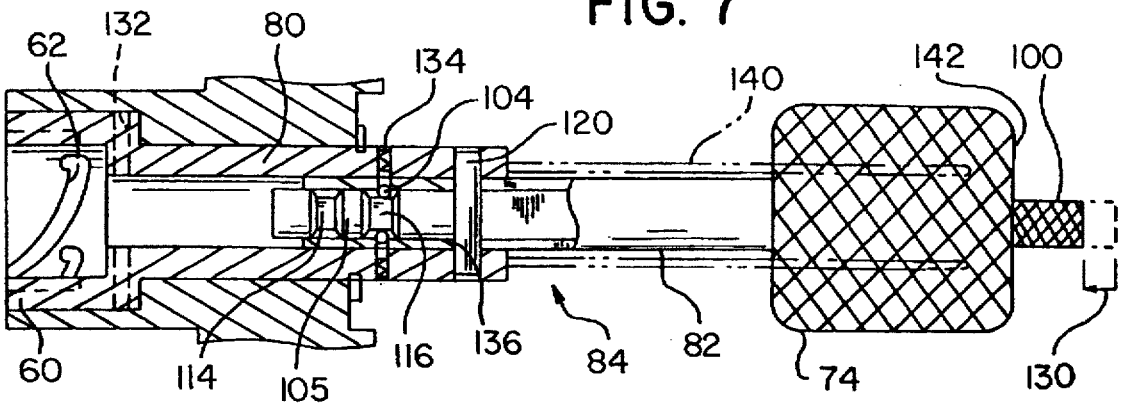
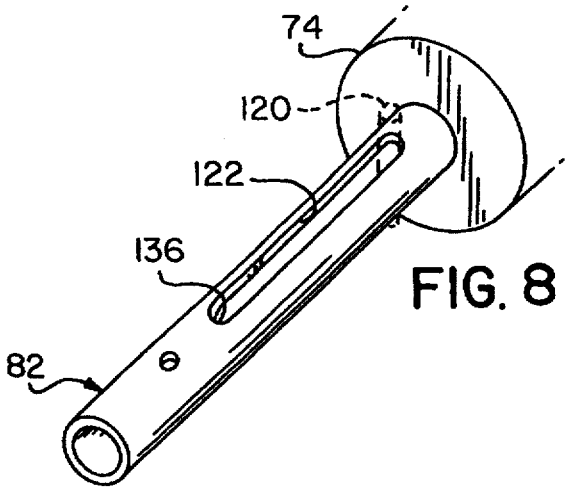
FIG. 8
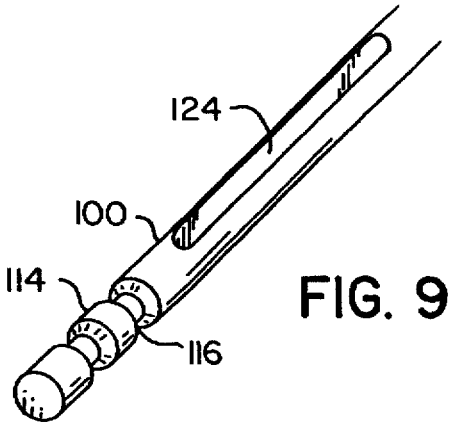
FIG. 9

CONNECTOR SYSTEM WITH QUICK COUPLING/DECOUPLING

BACKGROUND OF THE INVENTION

Where a number of connectors are to be mounted on a panel, two types are commonly used, one being a circular type and the other being rectangular. The circular type commonly has a bayonet-type nut around the rest of the connector, the nut being engageable with thread pins of a mating connector device, so turning of the nut draws the connectors together for full mating. A disadvantage of this type is that room has to be left for a technician to place his hands around each nut, so the circular connectors must be widely spaced when mounted on the panel. The rectangular connectors such as the D-sub type, commonly do not have any quick coupling/decoupling nut mechanism for engaging a mating connector. It would be possible to draw a pair of rectangular connectors together by turning screws at opposite ends of the connectors which are engaged with threads of the mating connector device. However, such screws would commonly be hidden under a large number of wires extending from the rear of the connectors, and the need to engage screws with nuts and turn them does not result in quick connect and disconnect. A connector system that allowed connectors to be closely spaced and which enabled individual connectors to be quickly coupled and decoupled from mating connector devices, even in an environment of a "rats nest" of wires, would be of value.

SUMMARY OF THE INVENTION

In accordance with one embodiment of the present invention, a connector is provided for use in a connector system, which enables quick coupling and decoupling to a mating connector device, even in an environment where a row of such connectors are closely spaced and in an environment of multiple wires. The connector includes a nut at the front of the connector for engaging a thread of the mating connector device, and a shaft arrangement that projects rearwardly from the nut and through the connector housing, to the rear, where a handle is provided to turn the nut. The shaft assembly includes first and second shafts wherein the first shaft is fixed to the nut and the second shaft is rotatably fixed to the first one but can slide rearwardly so its handle is moved rearward and not closely surrounded by handles of the other connectors or by the multiple wires. A release/lock rod projects through the handle and rearwardly thereof. When the rod is moved axially, a mechanism at the front end of the rod unlocks the second shaft to allow it to move rearwardly.

In a rectangular connector with two sets of longitudinally-spaced contacts, the nut lies near the longitudinal middle of the connector, between the two sets of contacts. A large diameter nut at this position can draw all portions of the connectors together to mate all contacts.

The novel features of the invention are set forth with particularity in the appended claims. The invention will be best understood from the following description when read in conjunction with the accompanying drawings.

BRIEF DESCRIPTION OF THE DRAWINGS

FIG. 7 is a sectional view of a portion of the apparatus of FIG. 6, with the shaft arrangement in the position shown in phantom lines in FIG. 6 for coupling and uncoupling.

FIG. 8 is a partial isometric view showing the second shaft of the shaft assembly of FIGS. 6 and 7.

FIG. 9 is a partial isometric view of the release/lock rod of the connectors of FIGS. 6 and 7.

DESCRIPTION OF THE PREFERRED EMBODIMENTS

Figure 1:
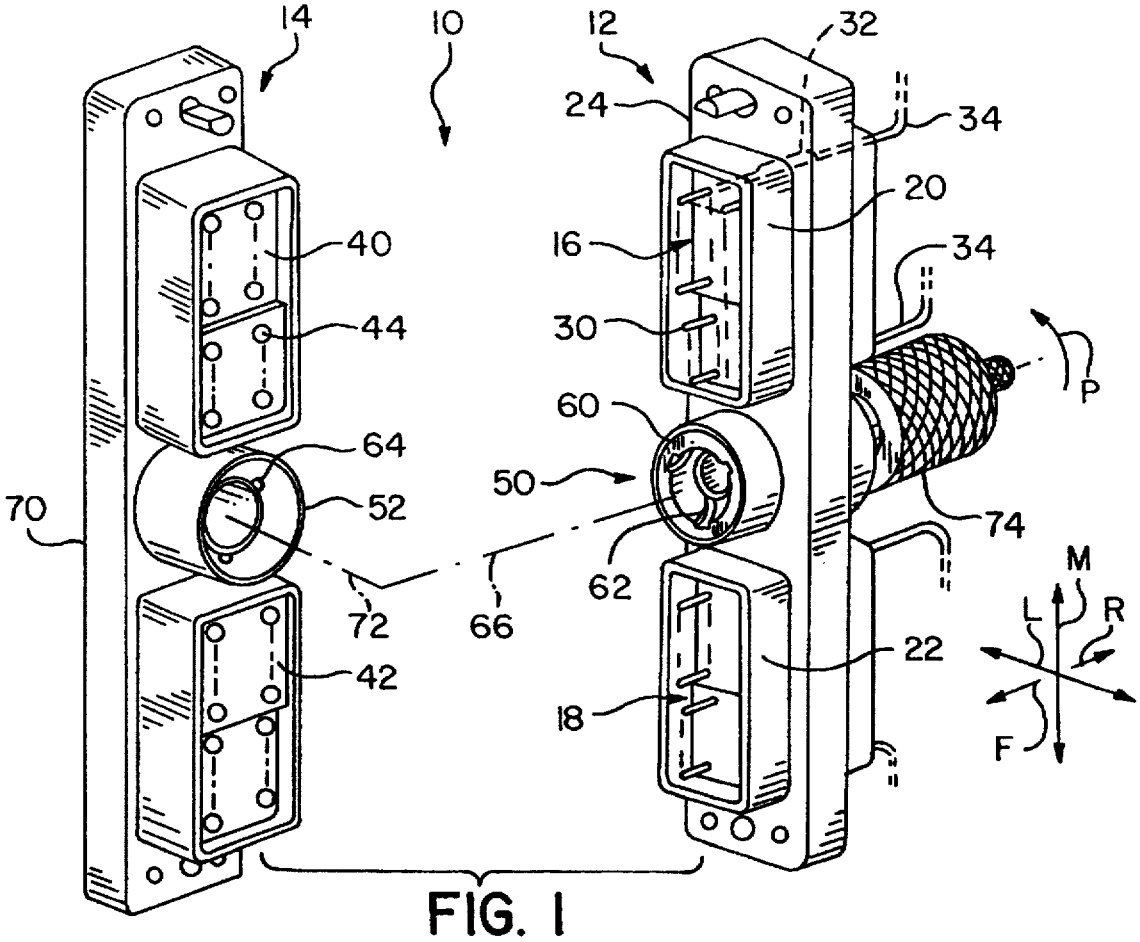
FIG. 1 is an exploded isometric view of a connector system of the present invention, showing a first connector and a second connector or connector device that can mate with the first connector.

FIG. 1 illustrates a connector system 10 which includes a first connector 12 of the receptacle type, and a second connector or connector device 14 of the plug type. The first connector 12 has a substantially rectangular shape when viewing the front of it along the rearward direction R, with a small lateral width in the direction L and a longer longitudinal length in the direction M. The connector has two sets of contacts 16, 18 which are longitudinally spaced apart. Each set of contacts includes an insert 20, 22 that can be mounted in a connector housing 24, with front ends 30 of the contacts facing forwardly, and with rear ends 32 of the contacts connected to wires 34. The second connector 14 is similarly constructed, with two sets of contacts 40, 42 having mating ends 44 that can mate with the contacts of the first connector. The first connector 12 has a quick coupling 50 which can quickly connect and disconnect to a quick coupling 52 of the second connector, with each coupling 50, 52 lying longitudinally between the sets of contacts of the corresponding connector.

The first connector coupling 50 includes a nut 60 with bayonet-type threads or grooves 62, which can mate with bayonet-type threads in the form of pins 64 of the second quick coupling 52. Of course, the connector thread couplings could be reversed, with the nut 60 of the first coupling 50 having pins (projecting inward or outward) and the second coupling 52 having grooves. The nut 60 is rotatably mounted about an axis 66 which extends in forward and rearward directions, and which is preferably generally coincident with the axis of the first connector. The pin-type threads 64 of the second connector are not rotatable, but are fixed in position and rotational orientation with respect to the housing 70 of the second connector. To mate the connectors, they are moved together along their axes 66, 72, with the threads or pins 64 of the second quick coupling 52 moving into the bayonet grooves 62 of the first coupling 50, and with a handle 74 of the first coupling then being turned by perhaps 160° in the direction P. During such turning, the bayonet nut 60 of the first connector is moved in the direction F, which causes the contacts to fully mate with each other.

Figure 6:
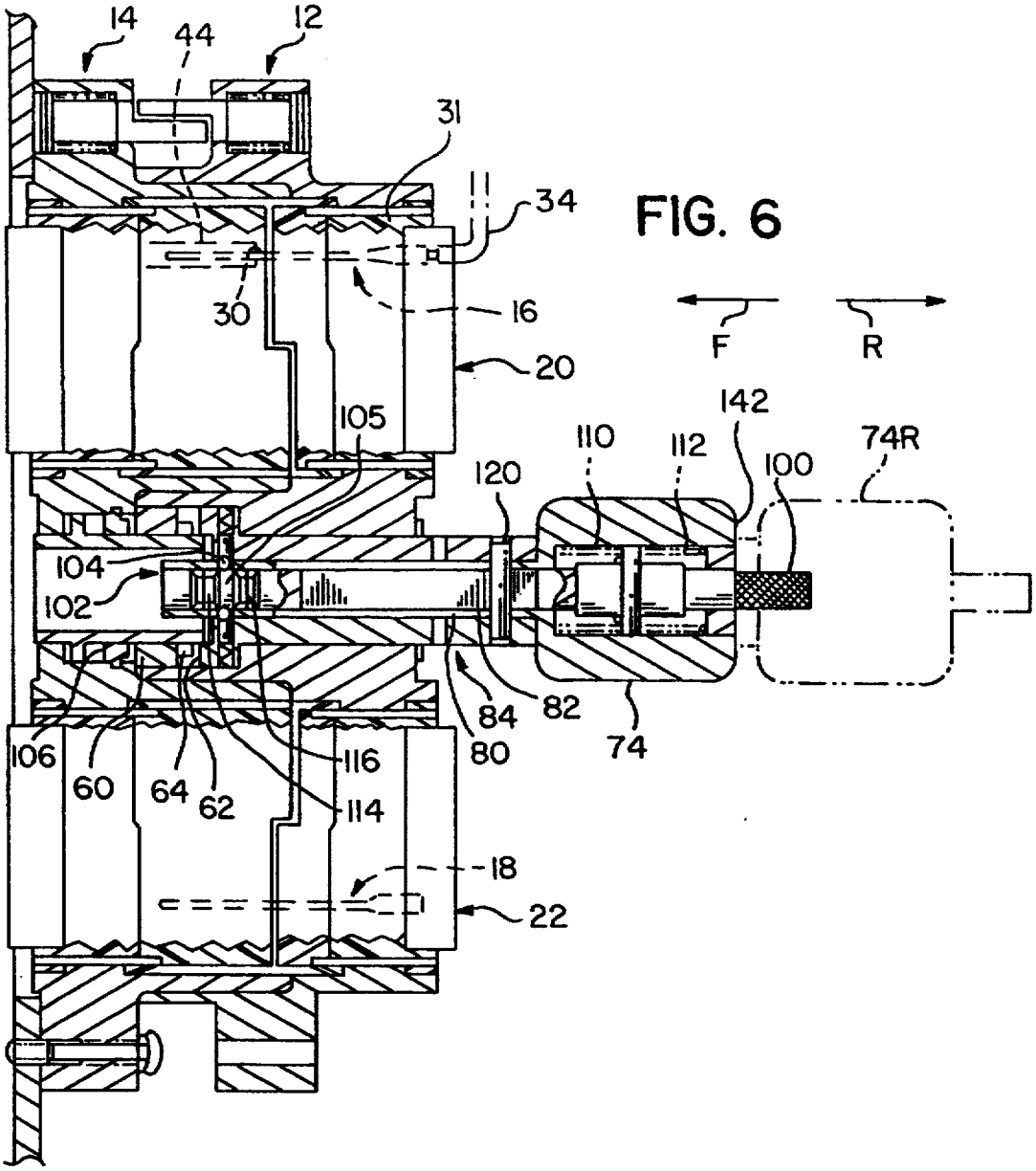
FIG. 6 is a partially sectional view showing the first and second connectors of FIG. 1 in a fully mated position, and showing, in phantom lines, the handle in a rearward position.

FIG. 6 shows the connectors 12, 14 fully mated, with contacts 30 lying in insulators 31 of the inserts. The bayonet pins 64 of the second connector are fully received in the bayonet grooves 62 of the nut 60 of the first connector. The handle 74 lies at the rear end of a second shaft 82 which can telescope within a first shaft 80 that is fixed to the bayonet nut 60. The first and second shafts 80, 82 are part of a shaft assembly 84 that facilitates turning of the nut 60 in an environment where there is limited space around the handle 74 for grasping and turning it. The second shaft 82 and the handle 74 at its rear, can slide rearwardly, so the handle lies at the rearward position 74R. In the forward position 74, the handle is commonly closely surrounded by handles of other connectors and by numerous wires 34 that make it difficult for a person to grasp the handle. However, when the handle is moved rearwardly to the position 74R, it lies rearward of the handles of other nearby connectors and of many of the wires 34, so a person can readily grasp the handle to turn it.

Figure 2:
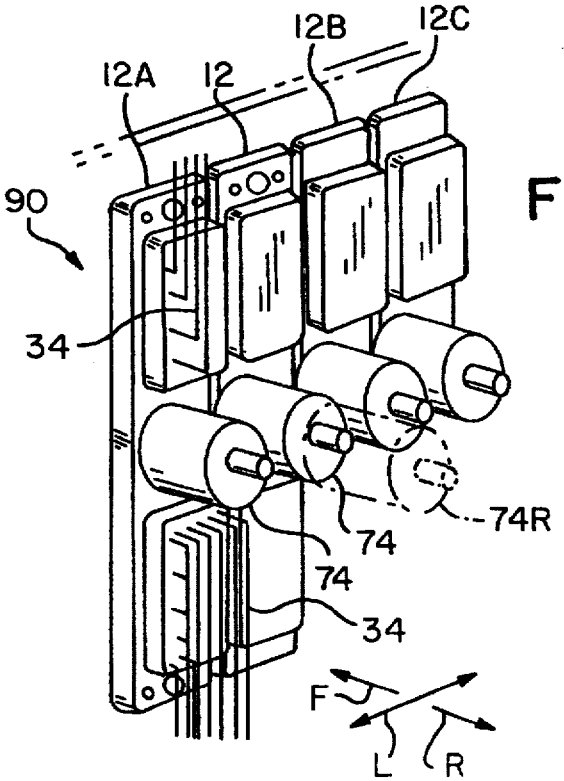
FIG. 2 is a partial rear view of the first connector and of other similar connectors shown arranged in a row.

FIG. 2 shows a system 90 that includes a plurality of first connectors, including the connector 12 and other substantially identical connectors such as 12A, 12B, and 12C. The connectors lie in a laterally-extending row, and are closely spaced along the row. As a result, the handles 74 of the connectors are closely laterally spaced. In addition, the wires 34 extending from the rear of each set of contacts, lie adjacent to the connector at its forward position 74. The combination of handles 74 lying on laterally opposite sides of the handle of connector 12, and the "rats nest" of wires 34 that lie on longitudinally opposite sides of the handle 74, make it difficult for a person to place his fingers around the selected handle 74 and turn it for quick coupling or decoupling to a mating connector device. However, applicant's construction which enables the handle to be moved to the rearward position 74R, makes grasping and turning of the handle much easier, since at the position 74R the handle lies rearward of the other adjacent handles and rearward of most of the wires 34.

Referring again to FIG. 6, it can be seen that the shaft assembly 84 includes a release/lock rod 100 that extends longitudinally through the second shaft 82. The front of the shaft arrangement forms a ball locking mechanism 102. A pair of balls 104 are shown trapped between the first and second shafts 80, 82, the balls preventing the second shaft and the handle 74 from moving rearwardly. A flange 105 on the rod keeps the balls in place. The rod 100 can be moved forwardly F against the force of a forward spring 110 and can be moved rearwardly R against the force of a rearward spring 112, the two springs tending to keep the rod in the centered position shown in FIG. 6. When the rod is pulled rearwardly or pushed forwardly, the balls tend to fall into grooves 114, 116, so they no longer lock the first and second shafts 80, 82 together. As a result, the second shaft 82 and the handle 74 at the rear of the second shaft, can move rearwardly, so the handle can move to the position 74R. The handle can be moved any amount rearwardly up to position 74R. At any position of the handle and the second shaft, the first and second shafts continue to be rotatably connected so they rotate together, by a dowel pin 120 that projects through the first and second shafts. FIGS. 8 and 9 show that the second shaft has elongated slots 122 that permit it to slide with respect the dowel pin 120. The rod 100 has a corresponding slot 124 that allows it to slide rearwardly with the second shaft 82.

FIG. 7 shows the shaft arrangement 84 with the rod 100 having been pushed forwardly by the distance 130 so the balls 104 lie in the groove 116, and with the second shaft 82 and pin 100 having thereafter been moved rearwardly together. Applicant can provide a second pair of ball-receiving holes 134, lying rearward of a forwardmost pair of ball-receiving holes 132. In that case, when the second shaft 80 and rod 100 have moved rearwardly far enough, as when the front end 136 of the second shaft slot abuts the dowel pin 120, the balls can move into the second holes 134. To do this, the rod 100 is allowed to move to its original position with respect to the second shaft member, which it tends to do under the influence of the springs 110, 112. In that case, the balls are pushed out of the slot 116 by a ramp leading to the flange 105. The balls then hold the second shaft 82 in the rearward position, so it does not tend to move forwardly while a person rotates the handle 74 to turn the nut 60.

FIG. 7 indicates a spring at 140 that could be installed to urge the handle 74 and second shaft 80 rearwardly. In that case, it would be only necessary to move the rod 100, as by pushing it forwardly with a person's finger to release it, so the spring 140 pushed the handle 74 and second shaft rearwardly to the position shown. Later, the handle 74 can be moved forwardly by moving the rod 100 and pushing against the handle rear surface 142 until the balls 104 click into the forward holes 132. The self-centering rod 100 tends to move the flange 105 to a position to push the balls radially outwardly.

Figures 3, 4, 5:
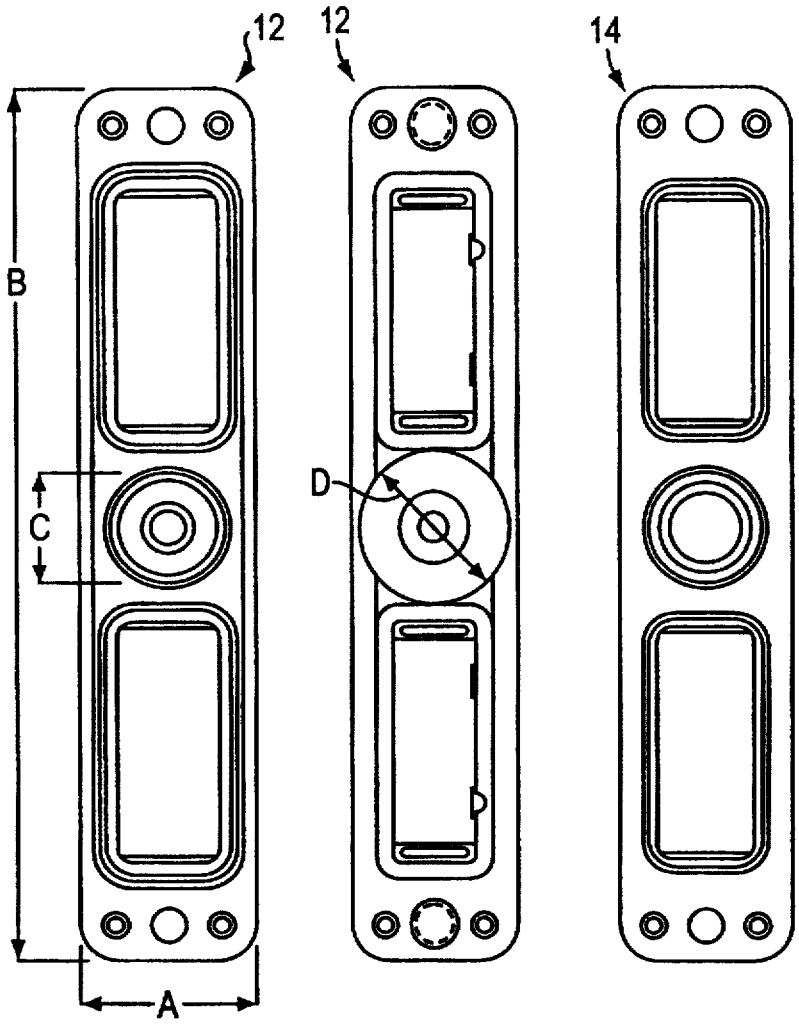
FIG. 3 is a front elevation view of the first connector of the system of FIG. 1.
FIG. 4 is a rear elevation view of the connector of FIG. 3.
FIG. 5 is a front elevation view of the second connector or connector device of the system of FIG. 1.

In a connector of the design illustrated that applicant has designed, the connector has a width A (FIG. 3) of 0.85 inch (22 mm), a height B of 4.4 inches (112 mm) with the nut having an outside diameter C of 0.62 inch (16 mm), and with the handle 74 having a diameter D (FIG. 4) of 0.80 inch (20 mm). The connectors can be mounted in a row, with substantially no lateral space between adjacent connectors. The nut outside diameter C of 0.62 inch is at least half the housing width A of 0.85 inch.

Thus, the invention provides apparatus for the quick coupling and decoupling of a connector to a mating connector device, which enables operation by turning a handle at the rear of the connector, and especially a rectangular connector, and wherein a handle of a selected one of a plurality of closely adjacent connectors is individually accessible. A shaft arrangement has a front end coupled to a nut to turn it, and has a rear end with a handle lying rearward of the connector housing, to turn the nut. The shaft arrangement includes first and second shafts that are rotatably connected to rotate together, but with the second shaft being slidable in forward and rearward directions so it can be telescoped and untelescoped from the first shaft. This allows a handle of a selected one of a plurality of connectors to be moved rearwardly so it can be readily turned. A release/lock rod projects through the first and second shafts and is movable axially with respect to the second shaft to operate a ball mechanism that locks and unlocks the second shaft from the first one to respectively prevent and allow sliding of the second shaft.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A connector that has an axis extending in forward-rearward directions, said connector including a housing with a front end for engaging a mating connector device and with a forwardly-opening connector coupling that can be turned to mate with a device coupling of the mating connector device, comprising:

a shaft arrangement that has a front end coupled to said connector coupling to turn it, said shaft arrangement including a portion extending rearwardly through said housing and having a rear end forming a handle for turning said shaft arrangement to turn said connector coupling;

said shaft arrangement including a first shaft connected to said connector coupling to turn with it and a second shaft rotatably coupled to said first shaft to turn with said first shaft, with said handle being mounted at a rear end of said second shaft, and with said second shaft being movable rearwardly with respect to said first shaft to provide more room for grasping of said handle to turn it and said connector coupling.

2. The connector described in claim 1 wherein said forward and rearward directions extend perpendicular to a longitudinal direction, and wherein:

said connector has first and second longitudinally-spaced sets of contacts which lie on longitudinally opposite sides of said connector axis;

said connector coupling lies about on said axis between said sets of contacts, so tightening of said connector coupling against said device coupling applies substantially equal mating forces to both of said sets of contacts.

3. The connector described in claim 1 wherein:

said shaft arrangement includes a release/lock rod that projects at least partially through said first and second shafts and which is axially movable with respect to said second shaft between lock and release positions, and means for locking and releasing said first and second shafts to respectively prevent and allow them to slide axially as said rod moves axially between said lock and release positions;

said rod having a rear end that projects through and rearward of said handle and that has a smaller outside diameter than said handle, so said rod rear end can be easily moved to permit rearward movement of said handle.

4. The connector described in claim 3 including:

a spring that biases said second shaft rearwardly to cause said second shaft to automatically move rearward when said rod is moved axially.

5. A connector system which includes a first connector with a first housing having an axis extending in forward and rearward axial directions which are perpendicular to a predetermined longitudinal direction, said housing having a pair of insert-receiving openings, and an insert lying in each of said openings with each insert including an insulator and a plurality of contacts mounted in the insulator, including:

a first connector coupling rotatably mounted on said housing about a coupling axis that lies between said insert-receiving openings and that extends parallel to said connector axis;

a shaft arrangement that extends through said housing, said shaft arrangement having a front end coupled to said connector coupling to turn it and having a rear end with a handle thereon that lies rearward of said housing;

a plurality of connectors that include said first connector and that are each substantially identical to said first connector, said plurality of connectors being arranged so they are closely spaced apart along a laterally-extending row of at least three of said plurality of connectors, wherein said lateral direction is perpendicular to said axial and longitudinal directions;

the shaft arrangement of each of said plurality of connectors includes first and second shafts that are telescopingly coupled to enable said second shaft to move rearwardly, but which are substantially fixed against relative rotation about said coupling axis, with the handle mounted on a rear end of said second shaft, whereby to enable rearward movement of the handle of a selected one of said connectors to a position rearward of the handles of the other connectors to mate or unmate the selected connector.

6. The system described in claim 5 wherein:

the shaft arrangement of each of said plurality of connectors includes a release/lock rod that has a rear end that projects through and rearwardly of said handle, said rod being slidable in a direction parallel to said coupling axis with respect to said first and second shafts, and including a mechanism that locks said second shaft in a forward position when it is telescoped into said first shaft but with said mechanism releasing said second shaft and said handle to move rearwardly when said rod is moved in a predetermined axial direction.

7. A connector system which includes a first connector (12) with a first housing (24) having a width (A) in a lateral direction (L) and having an axis (66) extending in forward and rearward axial directions (F, R) which are perpendicular to a predetermined longitudinal direction (M) and to said lateral direction, said housing having a pair of longitudinally-spaced insert-receiving openings, and an insert (20, 22) lying in each of said openings with each insert including an insulator and a plurality of contacts mounted in the insulator, including:

a first connector coupling (50) rotatably mounted on said housing about a coupling axis (66) that lies between said insert-receiving openings and that extends parallel to said connector axis;

a shaft arrangement (84) that extends through said housing, said shaft arrangement having a front end coupled to said connector coupling to turn it and having a rear end with a handle 74 thereon that lies rearward of said housing;

said first connector coupling comprises a nut with internal grooves (62), said nut having an outside diameter (C) that is at least half as great as the width (A) of said housing, to provide strength so turning of only said nut can reliably move and mate said connector to a mating connector device and the shaft arrangement of each of said plurality of connectors includes first and second shafts that are telescopingly coupled to enable said second shaft to move rearwardly, but which are substantially fixed against relative rotation about said coupling axis, with the handle mounted on a rear end of said second shaft.

* * * * *